US006787947B2

(12) United States Patent
Coulon et al.

(10) Patent No.: US 6,787,947 B2
(45) Date of Patent: Sep. 7, 2004

(54) COOLING THE UPSTREAM END PLATE OF A HIGH PRESSURE TURBINE BY MEANS OF A SYSTEM OF DUAL INJECTORS AT THE END OF THE COMBUSTION CHAMBER

(75) Inventors: Sylvie Coulon, Bois le Roi (FR); Gérard Stangalini, Fontainebleau (FR); Jean-Claude Taillant, Vaux le Penil (FR); Gérard Adam, Lieusaint (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 10/445,354

(22) Filed: May 27, 2003

(65) Prior Publication Data

US 2003/0223893 A1 Dec. 4, 2003

(30) Foreign Application Priority Data

May 30, 2002 (FR) ..... 02 06600

(51) Int. Cl.[7] ..... H02K 9/00

(52) U.S. Cl. ..... 310/52; 310/59; 415/115; 416/95

(58) Field of Search ..... 310/52–59; 60/39.02, 60/39.29, 39.53; 415/115, 180; 416/95–97

(56) References Cited

U.S. PATENT DOCUMENTS 3,832,090 A * 8/1974 Matto ..... 416/95
4,466,239 A * 8/1984 Napoli et al. ..... 60/782
4,657,482 A * 4/1987 Neal ..... 415/176
4,807,433 A 2/1989 Maclin et al.
4,822,244 A 4/1989 Maier et al.
5,143,512 A * 9/1992 Corsmeier et al. ..... 415/115
5,310,319 A * 5/1994 Grant et al. ..... 416/220 R
5,402,636 A * 4/1995 Mize et al. ..... 60/806
5,816,776 A 10/1998 Chambon et al.

FOREIGN PATENT DOCUMENTS

FR 2 541 371 8/1984
FR 2 707 698 1/1995

* cited by examiner

*Primary Examiner*—Thanh Lam
(74) *Attorney, Agent, or Firm*—Oblon, Spivak, McClelland, Maier & Neustadt, P.C.

(57) ABSTRACT

The invention relates to a device for ventilating a high pressure turbine rotor which comprises a turbine disk and an upstream end plate. A first circuit for cooling blades delivers a first air flow via main injectors and holes formed in the end plate. A second cooling circuit delivers a second air flow through a discharge baffle situated downstream from the compressor, a fraction of this second flow serving to cool the upstream top face of the end plate through a second baffle situated beneath the main injectors. A branch connection is provided between the first circuit and the enclosure situated downstream from the second baffle and it delivers a third flow which is set into pre-rotation by additional injector means formed in the form of inclined bores.

6 Claims, 5 Drawing Sheets

COOLING THE UPSTREAM END PLATE OF A HIGH PRESSURE TURBINE BY MEANS OF A SYSTEM OF DUAL INJECTORS AT THE END OF THE COMBUSTION CHAMBER

The invention relates to the field of ventilating high pressure turbine rotors in turbojets.

FIELD OF THE INVENTION

More precisely, the invention relates to a ventilation device for a high pressure turbine rotor of a turbomachine, said turbine being disposed downstream from the combustion chamber and comprising firstly a turbine disk presenting an internal aperture and an upstream flange for fixing to the downstream cone of a high pressure compressor, and secondly an end plate disposed upstream from said disk and separated therefrom by a cavity, said end plate comprising a solid radially inner portion likewise having an internal aperture, through which the upstream flange of said disk extends, and an upstream flange for being fixed to said downstream cone, said device comprising a first circuit for cooling blades fed with a first flow of air taken from the end of the combustion chamber and delivering said first flow of air into said cavity via main injectors disposed upstream from said end plate, and ventilation holes formed through said end plate, and a second circuit for cooling the end plate fed with a second flow of air through a discharge baffle situated downstream from the high pressure compressor, at least a fraction of said second air flow serving to ventilate the upstream top face of said end plate through a second baffle situated beneath the injectors.

BACKGROUND OF THE INVENTION

FIG. 1 shows such a high pressure turbine rotor 1 placed downstream from a combustion chamber 2 and comprising a turbine disk 3 carrying blades 4, and an end plate 5 placed upstream from the disk 3. The disk 3 and the end plate 5 include respective upstream flanges referenced 3*a* for the disk 3 and 5*a* for the end plate, enabling them to be fixed to the downstream end 6 of the downstream cone 7 of the high pressure compressor driven by the rotor 1.

The disk 3 has an internal aperture 8 passing the shaft 9 of a low pressure turbine, and the end plate 5 has an internal aperture 10 surrounding the flange 3*a* of the disk 3, and ventilation holes 11 through which a first flow C1 of cooling air taken from the end of the combustion chamber is delivered into the cavity 12 between the downstream face of the end plate 5 and the upstream face of the disk 3. This cooling air flow C1 flows radially outwards and penetrates into the slots 4*a* containing the roots of the blades 4 in order or cool them. This air flow is taken from the end of the combustion chamber, flows along a duct 13 disposed in the enclosure 14 separating the end plate 5 from the end of the combustion chamber, and it is set into rotation by injectors 15 so as to lower the temperature of the air delivered into the cavity 12.

A second flow of cooling air C2 taken from the end of the combustion chamber flows downstream in the enclosure 16 separating the downstream cone 7 of the high pressure compressor from the inner casing 17 of the combustion chamber 2. This air flow C2 flows through a discharge baffle 18 and penetrates into the enclosure 14 from which a fraction C2*a* flows through orifices 19 formed in the upstream flange 5*a* of the end plate 5, passes through the bore 10 in the end plate 5 and serves to cool the radially inner portion thereof, joining the cooling air flow C1 for the blades 4. Another fraction C2*b* of the second air flow C2 cools the upstream face of the end plate 5, flows round the injectors 15, and is exhausted into the upstream purge cavity 20 of the turbine rotor 1.

Finally, a third fraction C2*c* of the second air flow C2 serves to ventilate the upstream top face 21 of the end plate 5 through a second baffle 22 situated beneath the injectors 15. This third fraction C2*c* penetrates into the enclosure 23 situated downstream from the second baffle 22 between the end plate 5 and the injectors 15, and it is exhausted into the upstream purge cavity 20 of the turbine rotor 1 through a third baffle 24 situated above the injectors 15, where it mixes with the first air flow C1.

The second air flow C2 serves to cool the downstream cone 7, the shaft connecting the high pressure compressor to the high pressure turbine, and the end plate 5. This second air flow flowing axially in an annular space defined by stationary walls secured to the combustion chamber and rotary walls secured to the rotor is subjected to heating due to the power dissipated between the rotor and the stator.

In order to lower the temperature of the upstream end plate so as to comply with its mechanical strength specifications, it is therefore necessary to increase the flow rate of the air C2 passing through the discharge baffle 18 situated downstream from the high pressure compressor, and to dump it either into the blade cooling circuit or else into the turbine flow upstream from the high pressure turbine wheel. This increase in flow rate increases the temperature of the cooling air for the blades because heated air is dumped into the blade cooling circuit, and reduces the performance of the turbine because of the air dumped into the turbine stream.

In addition, the air flow C2*c* for cooling the end plate downstream from the second baffle 22 situated beneath the injectors 15 is difficult to control since it is subjected to variations in the clearance through the discharge baffle 18, through the second baffle 22, and through the third baffle 24 situated above the injectors 15 as occurs in operation over the lifetime of the engine.

The temperature of the upstream face of the end plate downstream from the second baffle is thus quite high and is poorly controlled. This makes it necessary to use special materials for making the end plate and requires suitable dimensioning.

OBJECT AND SUMMARY OF THE INVENTION

The object of the invention is to lower the temperature of the upstream face of the end plate in order to make it easier to dimension for overspeed, to increase its lifetime, and to be able to use a low cost material.

According to the invention, this object is achieved by the fact that said device further comprises a branch connection between the first circuit and the enclosure situated downstream from the second baffle, said branch connection delivering a third flow of air for cooling the upstream top face of the radially inner portion of said end plate, said third flow of air being entrained into pre-rotation by means of additional injectors.

This third air flow that is pre-entrained and injected downstream from the baffle under the main injectors thus serves to reduce the relative total temperature of the air cooling the upstream face of the end plate downstream from the second baffle. This third flow of air mixes with the leakage flow from the baffle under the injectors and is exhausted downstream from the main injectors of the turbine into the circuit for feeding the high pressure turbine wheels.

The air injected into the turbine wheel feed circuit is thus cooler than the air injected in the state of the art.

Advantageously, the additional injectors are made in the form of bores that are tangentially inclined in the direction of rotation of the rotor.

Preferably, said bores take air from the main injectors and deliver it immediately downstream of the second baffle.

BRIEF DESCRIPTION OF THE DRAWINGS

Other advantages and characteristics of the invention appear on reading the following description made by way of example and with reference to the accompanying drawings, in which.

MORE DETAILED DESCRIPTION

Figure 1:
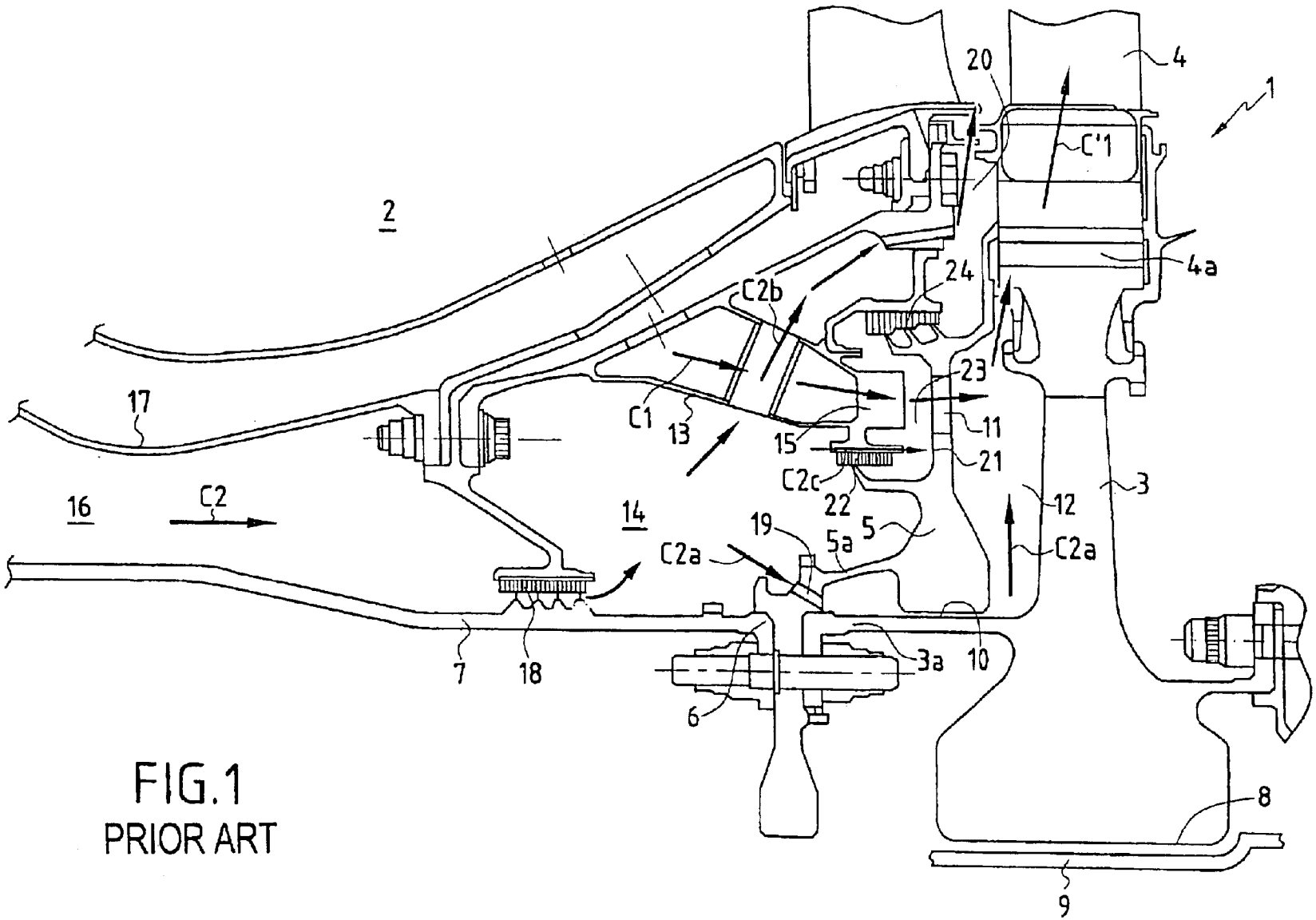
FIG.1 PRIOR ART
FIG. 1 is an axial half-section of a high pressure turbine rotor of a turbojet, showing the cooling air circuits in the prior art.

The state of the art shown in FIG. 1 is described in the introduction and needs no further explanation.

Figure 2:
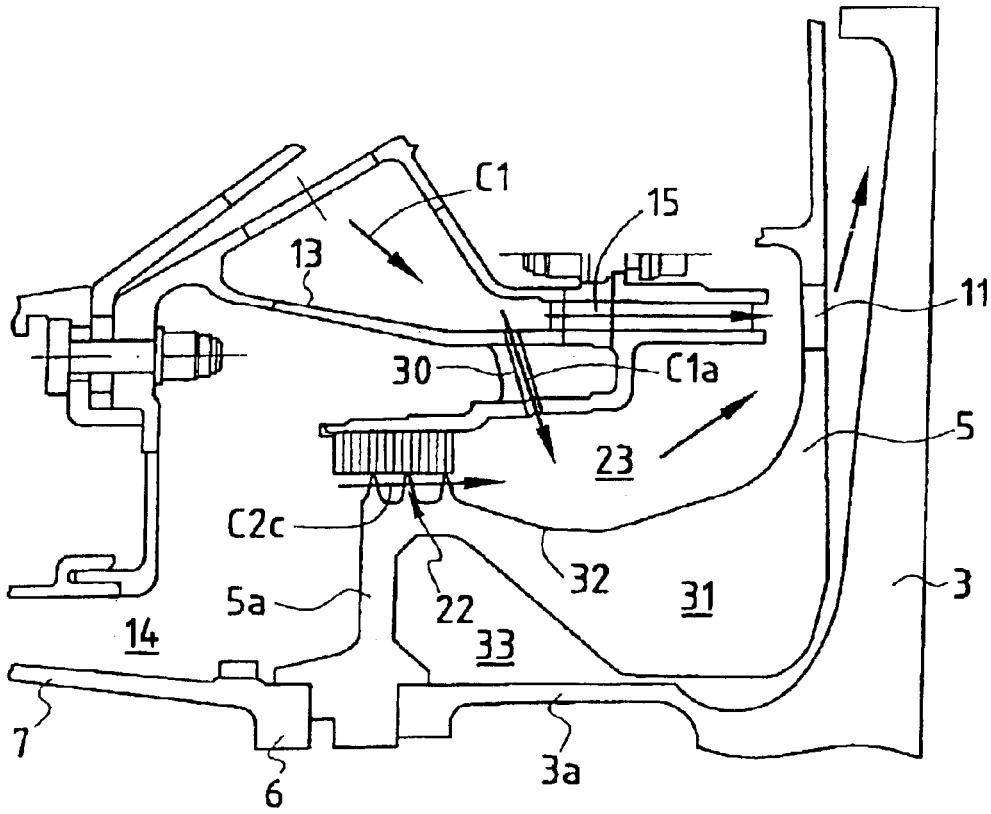
FIG. 2 is an axial half-section of a turbojet turbine rotor that includes the cooling device of the invention.

FIG. 2 shows a turbine rotor 1 which differs from that shown in FIG. 1 by the fact that the enclosure 23 situated downstream from the second baffle 22 is fed with air firstly by an air leak C2*c* coming from the enclosure 14 via the second baffle 22, and secondly by an air flow C1*a* delivered by a branch connection formed between the duct 13 delivering the first air flow C1 and the enclosure 23. The branch connection is constituted by a plurality of bores 30 opening out at one end into the inlets of the main injectors 15, and at the other end into the enclosure 23 immediately downstream from the second baffle 22. The bores 30 are cylindrical and inclined tangentially in the direction of rotation of the turbine rotor 1.

As can be seen in FIG. 2, the radially inner portion 31 of the end plate 5 is bulky in shape, and it extends axially towards the front end of the engine to the radial flange 5*a* which serves to fix it to the downstream end 6 of the downstream cone 7 of the compressor. The baffle 22 situated beneath the injectors 15 is disposed at the periphery of the radial flange 5*a*. The bores 30 are substantially radial and directed towards the top face 32 of the radially inner portion of the end plate 5.

Because the bores 30 are inclined in the direction of rotation of the turbine rotor 1, the air flow C1*a* delivered by the bores 30 is at a relative total temperature that is lower than that of the cooling air in the same regions in the prior art.

The temperature reduction can be estimated at 30° C. The air flow C1*a* mixes with the leakage flow C2*c* from the baffle 22 beneath the injectors and is removed downstream from the main injectors 15 in the circuit for feeding the turbine wheel.

As can be seen in FIG. 2 the radial flange 5*a* does not have orifices for feeding the annular chamber 33 situated between the radially inner portion 31 of the end plate 5 and the downstream flange 3*a* of the turbine disk 3, because the third air flow C1*a* is sufficient on its own for providing all of the cooling of the end plate 5.

The air injected into the circuit for feeding the turbine wheel to cool the blades and as pre-entrained in this way is cooler than the cooling air for the blades in conventional ventilation. The temperature reduction can be estimated at 15° C., which is equivalent to a saving in specific consumption of about 0.06%.

In addition, the cold air flow C1*a* delivered by the bores 30 is not influenced by variations in the clearance through the surrounding baffles, since this flow is at a rate calibrated by the bores 30.

Figure 3:
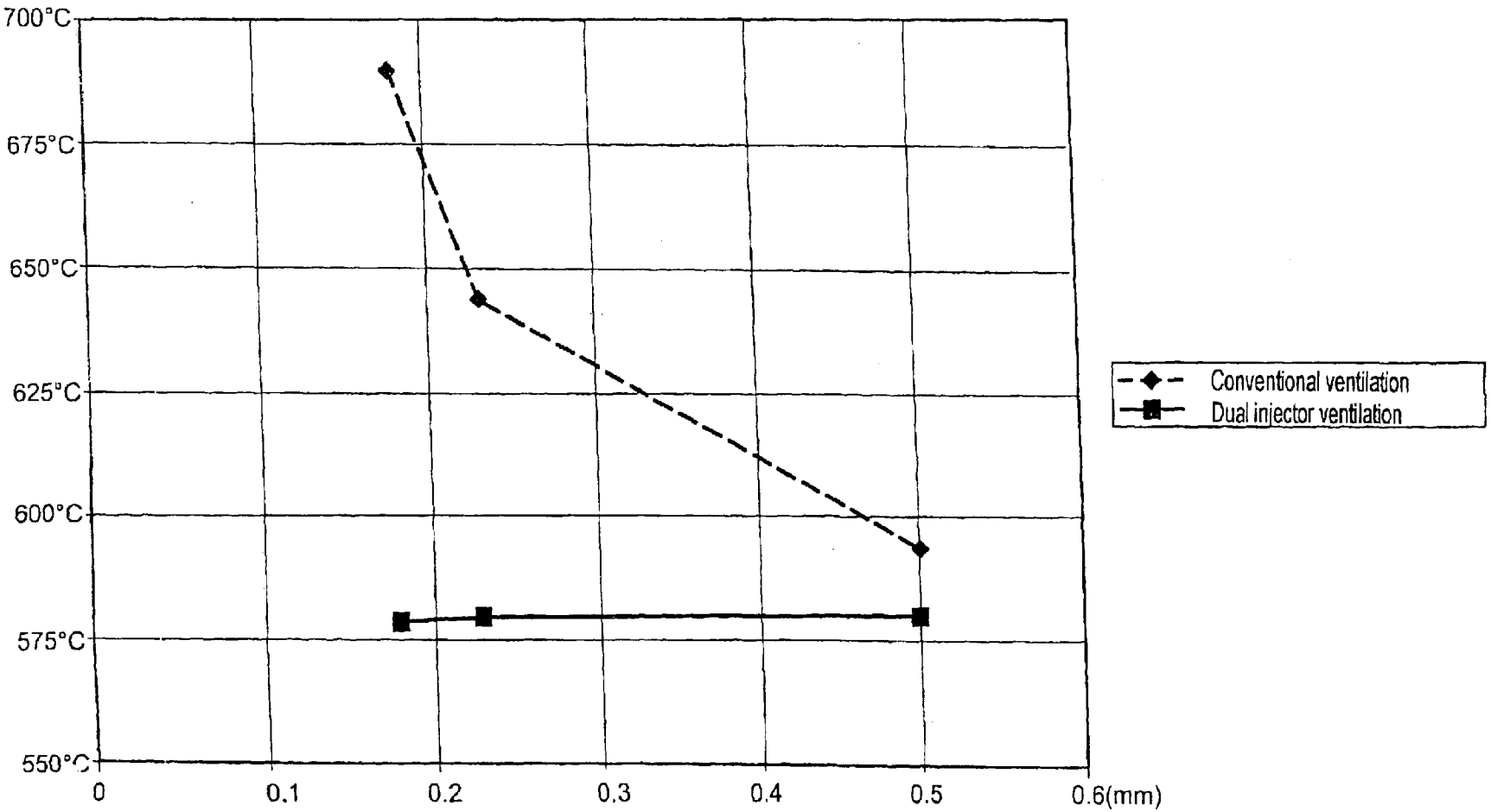
FIGS. 3 to 5 show how temperature varies in the aperture of the upstream end plate respectively as a function of clearance through the discharge baffle of the compressor, through the baffle under the injectors, and through the baffle over the injectors, both when using a conventional ventilation device and when using a ventilation device of the invention.

In FIG. 3, dashed lines show how the temperature of the bore 31 in the end plate 5 varies with conventional ventilation of the turbine rotor, while the continuous line shows how temperature varies at the same location using the ventilation device of the invention, variation being plotted as a function of clearance through the discharge baffle 18 expressed in millimeters (mm).

It can be seen that, with the device of the invention, this temperature is substantially constant and always lower than the temperature obtained in the same location with conventional variation.

Figure 4:
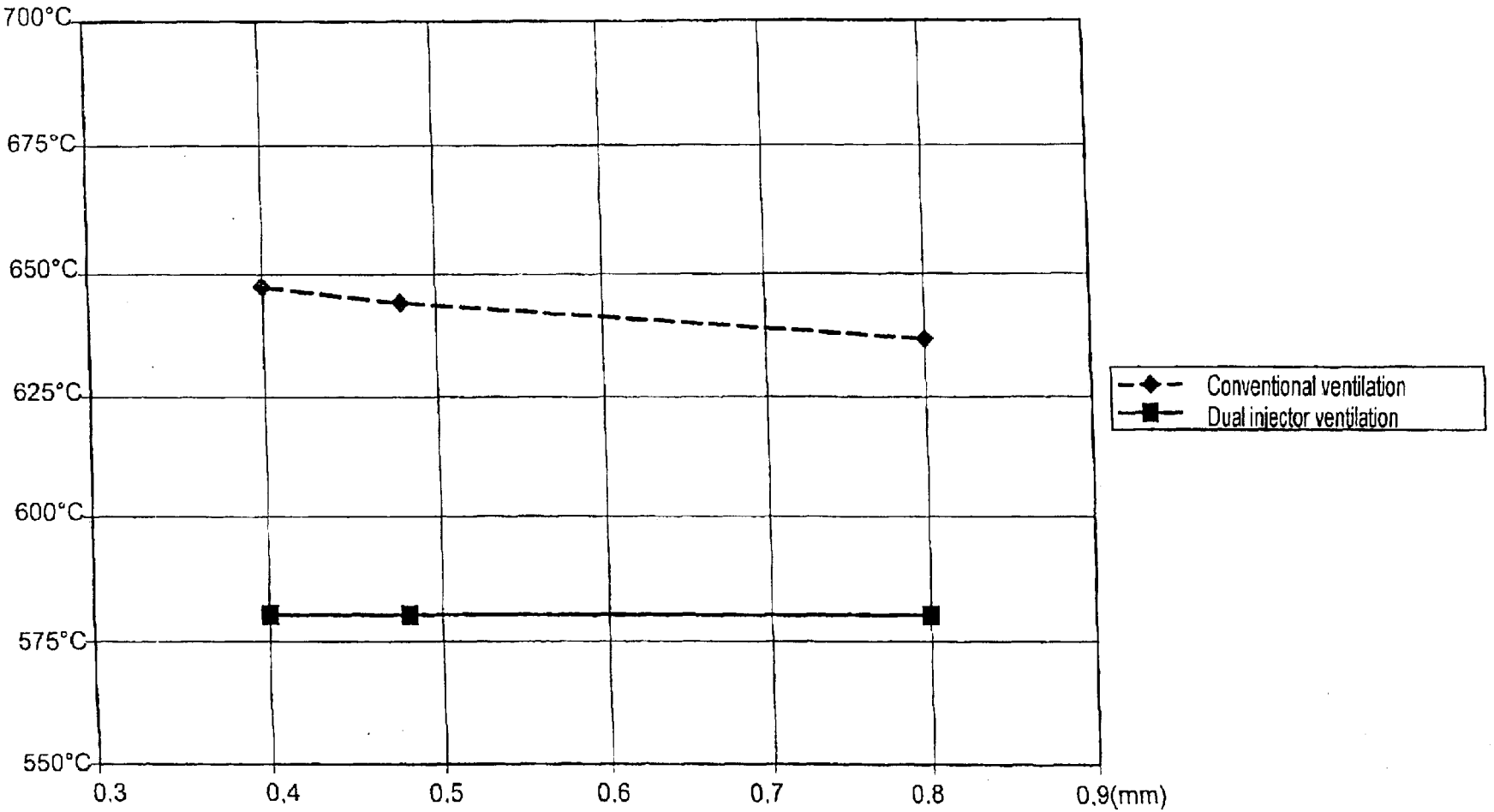

FIG. 4 shows variation in the temperature of the bore 31 in the end plate 5 as a function of the clearance in the second baffle 22 situated beneath the main injectors 15, both with conventional ventilation (dashed line curves) and with the ventilation device of the invention.

It can likewise be seen that, other things being equal, the temperature in this zone using the device of the invention is substantially constant and lower than the temperature obtained when using conventional ventilation.

Figure 5:
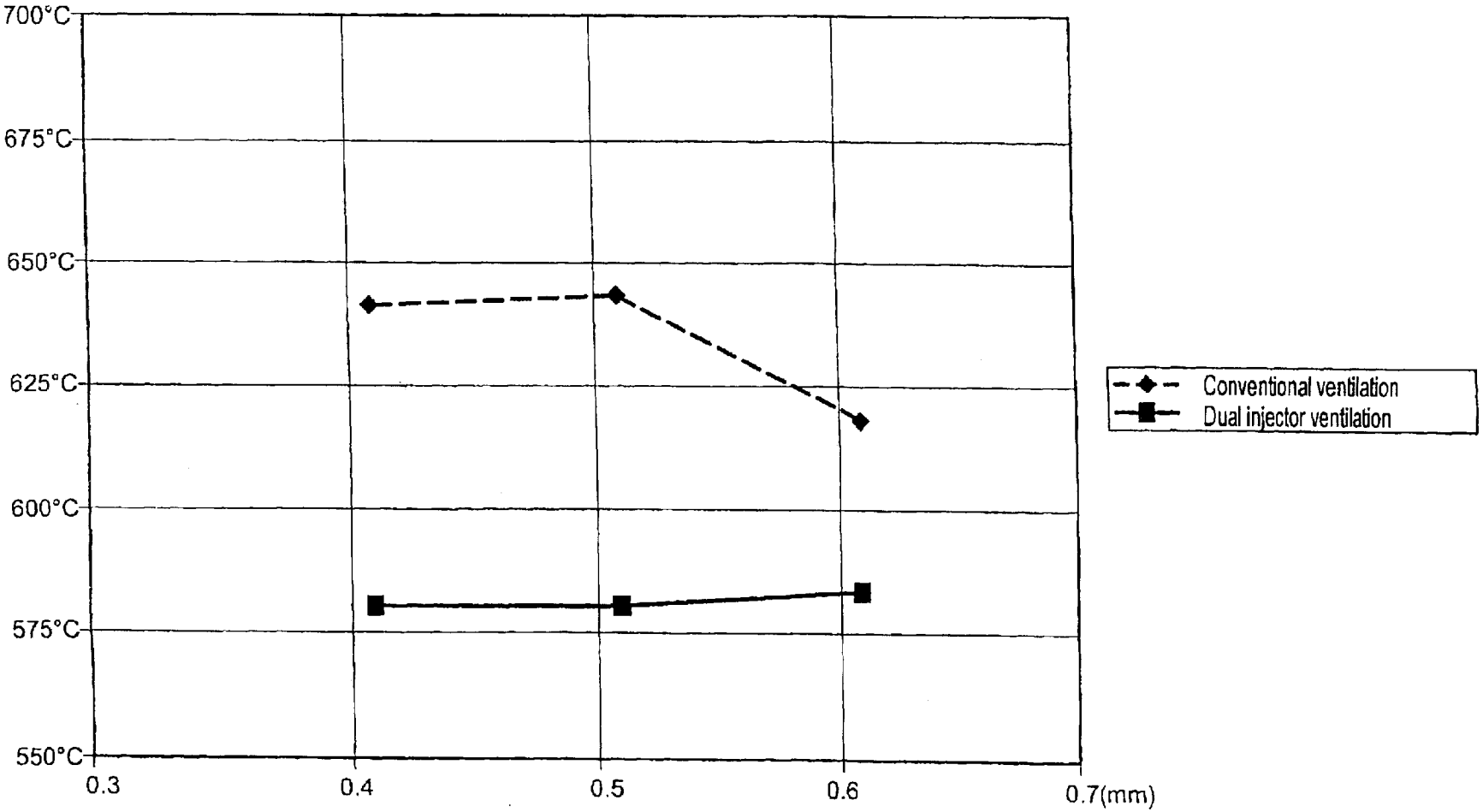

FIG. 5 shows how the temperature at the same location of the end plate varies as a function of clearance through the third baffle 24, for conventional ventilation (dashed line curve) and for ventilation with the device of the invention. The temperature in this region is substantially constant with the ventilation device of the invention.

Because the temperature of the end plate 5 in the vicinity of the third baffle 24 is substantially constant with the ventilation device of the invention, and lower than the temperature obtained with conventional ventilation, the end plate 5 is less subject to thermal stresses and can be made of a material that is less expensive and easier to work.

What is claimed is:

1. A ventilation device for a high pressure turbine rotor of a turbomachine, said turbine being disposed downstream from the combustion chamber and comprising firstly a turbine disk presenting an internal aperture and an upstream flange for fixing to the downstream cone of a high pressure compressor, and secondly an end plate disposed upstream from said disk and separated therefrom by a cavity, said end plate comprising a solid radially inner portion likewise having an internal aperture, through which the upstream flange of said disk extends, and an upstream flange for being fixed to said downstream cone, said device comprising a first circuit for cooling blades fed with a first flow of air taken from the end of the combustion chamber and delivering said first flow of air into said cavity via main injectors disposed upstream from said end plate, and ventilation holes formed through said end plate, and a second circuit for cooling the end plate fed with a second flow of air through a discharge baffle situated downstream from the high pressure compressor, at least a fraction of said second air flow serving to ventilate the upstream top face of said end plate through a second baffle situated beneath the injectors, the device further comprising a branch connection between the first circuit and the enclosure situated downstream from the second baffle, said branch connection delivering a third flow of air for cooling the upstream top face of the radially inner portion of said end plate, said third flow of air being entrained into pre-rotation by means of additional injectors.

2. A device according to claim 1, wherein the additional injectors are implemented in the form of bores that are inclined tangentially in the direction of rotation of the rotor.

3. A device according to claim 2, wherein said bores take air from inside the main injectors.

4. A device according to claim 3, wherein said bores deliver air immediately downstream from the second baffle.

5. A device according to claim 2, wherein the second baffle is disposed between the main injectors and the upstream flange of the end plate.

6. A device according to claim 5, wherein the upstream flange of the end plate is radial.

* * * * *